US005520832A

United States Patent [19]

Alexander

[11] Patent Number: 5,520,832

[45] Date of Patent: May 28, 1996

[54] TRACTOR HYDRAULIC FLUID WITH WIDE TEMPERATURE RANGE (LAW180)

[75] Inventor: Albert G. Alexander, Sarnia, Canada

[73] Assignee: Exxon Research and Engineering Company, Florham Park, N.J.

[21] Appl. No.: 330,779

[22] Filed: Oct. 28, 1994

[51] Int. Cl.[6] ..... C10M 145/14

[52] U.S. Cl. ..... 252/56 R; 252/79; 208/19

[58] Field of Search ..... 252/56 R, 79; 208/19

[56] References Cited

U.S. PATENT DOCUMENTS

| | | | |
|---|---|---|---|
| 2,091,627 | 8/1937 | Bruson | 252/56 R |
| 2,616,854 | 11/1952 | Fenske | 252/56 R |
| 3,250,716 | 5/1966 | Akers | 208/19 |
| 3,607,749 | 9/1971 | Forbes | 252/56 R |
| 3,679,644 | 7/1972 | van der Meij | 252/56 R |
| 3,764,537 | 11/1973 | MacLeod | 252/56 R |
| 3,996,144 | 12/1976 | Weetman et al. | 252/56 R |
| 4,203,854 | 5/1980 | Silverstein | 252/25 |
| 4,776,967 | 10/1988 | Ichichashi | 252/56 R |
| 4,800,013 | 1/1989 | Yamane et al. | 208/19 |
| 4,822,508 | 4/1989 | Pennewiss et al. | 252/56 R |
| 4,844,829 | 7/1989 | Wilburn et al. | 252/56 R |
| 4,956,111 | 9/1990 | Wilburn et al. | 252/56 R |
| 4,968,444 | 11/1990 | Knoell et al. | 252/56 R |
| 5,043,087 | 8/1991 | Pennewiss et al. | 252/56 R |
| 5,149,452 | 9/1992 | MacAlpine et al. | 252/56 R |
| 5,229,021 | 7/1993 | Pillon et al. | 252/56 R |

FOREIGN PATENT DOCUMENTS

| | | | |
|---|---|---|---|
| 1074919 | 11/1965 | United Kingdom | 208/19 |

*Primary Examiner*—Margaret Medley
*Attorney, Agent, or Firm*—Joseph J. Allocca

[57] ABSTRACT

A lubricant oil composition suitable for use as a tractor hydraulic fluid which comprises (a) a lubricating oil base stock which is a blend of a major amount of paraffinic mineral oil and a minor amount of a naphthenic mineral oil, and (b) a blend of a polymethacryalte viscosity index improver having a weight average molecular weight of 25,000 to 150,000 and a shear stability index less than 5 and a polymethacryate viscosity index improver having a weight average molecular weight of 500,000 to 1,000,000 and a shear stability index of 25 to 60. The formulated oil composition has a kinematic viscosity of 8.0 to 9.0 cSt at 100° C., a minimum kinematic viscosity of 7.0 cSt at 100° C. after 30 shear cycles, a maximum Brookfield viscosity of 17,000 cSt at –40° C. and a maximum pour point of –45° C.

4 Claims, No Drawings

TRACTOR HYDRAULIC FLUID WITH WIDE TEMPERATURE RANGE (LAW180)

BACKGROUND OF THE INVENTION

1. Field of the Invention

This invention relates to a lubricating oil composition suitable for use as an all-season tractor hydraulic fluid.

2. Description of the Related Art

Tractor hydraulic fluids are multi-application lubricants that are used in transmissions, differentials, final-drive planetary gears, wet-brakes and hydraulic systems of off-highway mobile equipment. Different types of fluids are used in such equipment depending on the design and severity of application. Generally, tractor fluids are designed to meet specific manufacturer requirements.

Some new types of tractors and other off-highway equipment have strict visocometric requirements which standard tractor hydraulic fluids have difficulty in meeting. Moreover, these stricter viscometric requirements may result in seasonal oil changes and even reformulation depending on such seasonal and application requirements.

It would be desirable to have an all-season, wide temperature range multi-application tractor hydraulic fluid so as to reduce the number of lubricants required on-site to meet different needs and to minimize or avoid oil changes due to seasonal changes.

SUMMARY OF THE INVENTION

This invention relates to a lubricating oil composition having improved viscometric properties and suitable for use as a tractor hydraulic fluid. The lubricating oil composition comprises:

(a) a lubricating oil base stock, said lubricating oil base stock comprising
  1) a major amount of paraffinic mineral oil having a kinematic viscosity of 3.0 to 6.0 cSt at 100° C., and
  2) a minor amount of a naphthenic mineral oil having a kinematic viscosity of 1.5 to 3.0 cSt at 100° C.;

(b) from 3 to 15 vol. % based on oil composition of a polymethacrylate viscosity index improver having a weight average molecular weight of 25,000 to 150,000 and a shear stability index less than 5; and (c) from 3 to 15 vol. % based on oil composition of a polymethacrylate viscosity index improver having a weight average molecular weight of 500,000 to 1,000,000 and a shear stability index of 25 to 60;

wherein the oil composition has a kinematic viscosity of 8.0 to 9.0 cSt at 100° C., a minimum kinematic viscosity of 7.0 cSt at 100° C. after 30 cycles shear, a maximum Brookfield viscosity of 17,000 cSt at −40° C. and a maximum pour point of −45° C.

The improved tractor hydraulic fluid meets the viscometric and shear stability requirements of new high efficiency tractors and related equipment as well as possessing all-season properties to minimize oil changes.

DETAILED DESCRIPTION OF THE INVENTION

The lubricating oil base stock contains a blend of a major amount of paraffinic mineral oil and a minor amount of naphthenic mineral oil. The paraffinic mineral oil is the higher viscosity component of the base stock blend with a viscosity of 3.0 to 6.0 cSt at 100° C. It is present in an amount of from 55 to 85 vol. %, preferably 60 to 80 vol. %, based on oil base stock. The naphthenic mineral oil is the lower viscosity component of the blend, has a viscosity of 1.5 to 3.0 cSt at 100° C., and is present in an amount of 15 to 45 vol. %, preferably 20 to 40 vol. % based on oil base stock.

The base oil blend provides for good low temperature performance while maintaining a minimum oil film thickness to protect moving parts such as bearings and gears. The naphthenic oil component enables the finished oil to achieve a maximum pour point of −45° C. and a maximum Brookfield viscosity of 17,000 cSt at −40° C. The paraffinic oil component provide the necessary oil film thickness to protect moving parts at high temperatures. Neither base oil component alone would impart all season properties to the finished oil.

The viscosity index (VI) improver is likewise a blend of two components. The first component is a polymethacrylate having a weight average molecular weight of 25,000 to 150,000, preferably 50,000 to 125,000 and a shear stability index of less than 5. This lower molecular weight component is present at from 3 to 15 vol. %, preferably 4 to 8 vol. % based on oil composition. The higher molecular weight component is also a polymethacrylate having a molecular weight of 500,000 to 1,000,000, preferably 600,000 to 900,000 and a shear stability index of 25–60. The amount of this component is from 3 to 15 vol. %, preferably 4 to 8 vol.%, based on oil composition. These polymethacryaltes are commercially available from Rohm and Haas under the trade name Acryloid®.

This blend of two viscosity index improvers provides the formulated oil with the viscometric properties needed for new tractors and other equipment. The lower molecular weight polymethacryalte imparts the minimum after-shear viscosity of 7.0 cSt at 100° C. after 30 cycles shear as measured by ASTM D 3945 while the higher molecular weight polymethacrylate provides a higher viscosity index. The combination of viscosity index improvers when blended with the base oil blend provides a formulated oil having excellent wide temperature range performance.

If desired, other conventional additives may be added to the tractor hydraulic fluid. Such additives include corrosion and rust inhibitors, anti-oxidants, dispersants, detergents, anti-foam agents, anti-wear agents, friction modifiers and flow improvers. Such additives are described in "Lubricants and Related Products" by Dieter Klamann, Verlag Chemie, Deerfield Beach, Fla., 1984.

This invention is further understood by reference to the following Example which includes a preferred embodiment of the invention.

Examples 1–15 and

Comparative Examples A–G

The target specification for tractor hydraulic fluids for new high efficiency tractors is given in Table 1.

TABLE 1

| Property | Target Value | Method Of Measurement |
|---|---|---|
| Kinematic Viscosity @ 100° C., cSt | 8.0 min. | ASTM D 445 |
| Viscosity Index | 210 typical | ASTM D 2270 |
| Brookfield @ −40° C., cP | 17,000 max. | ASTM D 2983 |
| Shear Stability | 7.0 min. | ASTM D 3945 |

TABLE 1-continued

| Property | Target Value | Method Of Measurement |
|---|---|---|
| after 30 cycles shear viscosity @ 100° C., cSt | | Procedure A |
| Pour Point, °C. | −45 max. | ASTM D 97 |
| Flash Point, °C. | 160 min. | ASTM D 92 |

Various tractor hydraulic fluid blends were prepared from the following components:

I. A paraffinic mineral base oil having a viscosity of 3.6–3.9 cSt at 100° C.

II. A naphthenic mineral base oil having a typical viscosity of about 2.2 cSt at 100° C.

III. Polymethacrylate having a weight average molecular weight of 750,000, shear stability index of about 45 and manufactured by Rohm and Haas.

IV. Polymethacryalte having a weight average molecular weight of 100,000, a shear stability index of about 1 and manufactured by Rohm and Haas.

V. Commercially available additive packages containing antiwear agent, detergent, antirust agent, copper corrosion inhibitor, antioxidant, friction modifier, pour point depressant and antifoam.

These various components were blended and their properties shown in Table 2.

TABLE 2

| | EXAMPLES | | | | | | | | | |
|---|---|---|---|---|---|---|---|---|---|---|
| | 1 | 2 | 3 | 4 | 5 | 6 | 7 | 8 | 9 | 10 |
| COMPONENTS, VOL % | | | | | | | | | | |
| I | 63.74 | 61.94 | 61.74 | 61.59 | 61.44 | 60.24 | 62.24 | 61.24 | 63.94 | 57.34 |
| II | 23.00 | 23.00 | 23.00 | 23.00 | 23.00 | 23.00 | 23.00 | 23.00 | 20.00 | 26.00 |
| III | 4.50 | 4.50 | 4.50 | 4.50 | 4.50 | 4.00 | 5.00 | 5.00 | 4.50 | 4.50 |
| IV | 2.00 | 3.80 | 4.00 | 4.15 | 4.30 | 6.00 | 3.00 | 4.00 | 4.80 | 5.40 |
| V | 6.76 | 6.76 | 6.76 | 6.76 | 6.76 | 6.76 | 6.76 | 6.76 | 6.76 | 6.76 |
| VISCOSITY - KIN | | | | | | | | | | |
| @ 40° C., cSt | — | — | — | — | — | — | — | — | — | — |
| @ 100° C., cSt | 7.50 | 8.22 | 8.35 | 8.40 | 8.49 | 8.86 | 8.35 | 8.83 | 8.87 | 8.87 |
| VI | — | — | — | — | — | — | — | — | — | — |
| VISCOSITY - BF | | | | | | | | | | |
| @ −40° C., Cp | — | 16,725 | 16,225 | 17,200 | 17,940 | 17,975 | 16,100 | 18,100 | 19,320 | 16,950 |
| POUR POINT, °C. | — | — | <−54 | — | — | — | <−57 | — | — | — |
| FLASH POINT, °C. | — | — | — | — | — | — | — | — | — | — |
| SHEAR | | | | | | | | | | |
| - 30 CYCLES, cSt | — | 6.77 | 6.94 | 7.00 | 7.22 | 7.63 | 6.79 | 7.17 | 7.43 | — |
| - 60 CYCLES, cSt | — | 6.67 | 6.86 | 6.95 | 7.14 | — | 6.73 | 7.09 | 7.37 | — |
| - 120 CYCLES, cSt | — | — | 6.80 | — | 7.13 | — | 6.67 | 7.01 | — | — |
| - 180 CYCLES, cSt | — | — | 6.79 | — | 7.13 | — | 6.67 | 7.02 | — | — |
| SHEAR | | | | | | | | | | |
| - 30 CYCLES, % | — | 17.64 | 16.89 | 16.71 | 14.96 | 13.88 | 18.68 | 18.76 | 16.17 | — |
| - 60 CYCLES, % | — | 18.86 | 17.84 | 17.32 | 15.90 | — | 19.40 | 19.68 | 16.86 | — |
| - 120 CYCLES, % | — | — | 18.56 | — | 16.02 | — | 20.12 | 20.59 | — | — |
| - 180 CYCLES, % | — | — | 18.68 | — | 16.02 | — | 20.12 | 20.47 | — | — |

| | EXAMPLES | | | | | COMPARATIVE EXAMPLES | | | | |
|---|---|---|---|---|---|---|---|---|---|---|
| | 11 | 12 | 13 | 14 | 15 | A | B | C | D | E |
| COMPONENTS, VOL % | | | | | | | | | | |
| I | 55.34 | 53.74 | 53.14 | 47.74 | 53.24 | 65.04 | 63.24 | 61.24 | 65.04 | 61.24 |
| II | 28.00 | 30.00 | 30.00 | 35.00 | 30.00 | 23.00 | 23.00 | 23.00 | 23.00 | 23.00 |
| III | 4.50 | 4.50 | 4.50 | 4.50 | 5.00 | 5.20 | 7.00 | 9.00 | — | — |
| IV | 5.40 | 5.00 | 5.60 | 6.00 | 5.00 | — | — | — | 5.20 | 9.00 |
| V | 6.76 | 6.76 | 6.76 | 6.76 | 6.76 | 6.76 | 6.76 | 6.76 | 6.76 | 6.76 |
| VISCOSITY - KIN | | | | | | | | | | |
| @ 40° C., cSt | — | — | 39.35 | — | — | 32.03 | — | — | — | — |
| @ 100° C., cSt | 8.82 | 8.61 | 8.84 | 8.81 | 9.07 | 7.25 | 8.92 | 10.96 | 5.21 | 6.71 |
| VI | — | — | 214 | — | — | 202 | — | — | — | — |
| VISCOSITY - BF | | | | | | | | | | |
| @ −40° C., Cp | 16,480 | 14,410 | 16,100 | 13,630 | 15,200 | 14,460 | 18,200 | 21,700 | 14,100 | 17,270 |
| POUR POINT, °C. | — | — | −58 | — | — | −54 | — | — | — | — |
| FLASH POINT, °C. | — | — | 190 | — | — | | | | | |
| SHEAR | | | | | | | | | | |
| - 30 CYCLES, cSt | — | 7.16 | 7.39 | 7.40 | — | 5.81 | 6.73 | 7.92 | 5.28 | 6.68 |
| - 60 CYCLES, cSt | — | 7.08 | 7.31 | 7.31 | — | 5.68 | — | — | 5.32 | 6.68 |
| - 120 CYCLES, cSt | — | 7.00 | 7.24 | — | — | 5.61 | — | — | 5.38 | 6.68 |

TABLE 2-continued

| | | | | | | | | | | |
|---|---|---|---|---|---|---|---|---|---|---|
| - 180 CYCLES, cSt | — | 6.96 | 7.26 | — | — | — | — | — | — | — |
| SHEAR | | | | | | | | | | |
| - 30 CYCLES, % | — | 16.84 | 16.35 | 15.96 | — | 19.86 | 24.55 | 27.74 | −1.44 | 0.43 |
| - 60 CYCLES, % | — | 17.77 | 17.26 | 16.99 | — | 21.66 | — | — | −2.11 | 0.48 |
| - 120 CYCLES, % | — | 18.70 | 18.06 | — | — | 22.62 | — | — | −3.34 | 0.43 |
| - 180 CYCLES, % | — | 19.16 | 17.84 | — | — | — | — | — | — | — |

Examples 1–5 demonstrate that for a given amount of components II and III, one must adjust the amount of component IV until the target specifications given in Table 1 are met. Thus, at 4.50 wt. % component III, increasing the amount of low shear, low molecular weight polymethacrylate (component IV) increases the kinematic viscosity and the shear. The target specifications are met at component IV concentration of 4.15 vol. %. Examples 6–8 show that decreasing the amount of component III requires increasing the amount of component IV, whereas increasing the amount of component III requires decreasing the amount of component IV (relative to Examples 1–5). Examples 9–14 demonstrate that increasing the amount of naphthenic basestock at constant amount of component III requires increasing amounts of component IV in order to attain target shear specifications.

Comparative Examples A–E illustrate the effect of omitting the combination of polymethacrylates. If only component III is present, it is necessary to increase concentration in order to achieve the requisite target shear. However, this results in unacceptable Brookfield viscosities. Using only component IV can achieve acceptable Brookfield viscosities but not acceptable kinematic viscosities or shear.

What is claimed is:

1. A lubricating oil composition suitable for use as a tractor hydraulic fluid which comprises:

(a) a lubricating oil base stock, said base stock comprising:

1) a major amount of paraffinic mineral oil having a kinematic viscosity of 3.0 to 6.0 cSt at 100° C., and 2) a minor amount of a naphthenic mineral oil having a kinematic viscosity of 1.5 to 3.0 cSt at 100° C.;

(b) from 4 to 8 vol. % based on oil composition of a polymethacryalte viscosity index improver having a weight average molecular weight of 50,000 to 125,000 and a shear stability index less than 5; and (c) from 4 to 8 vol. % based on oil composition, of a polymethacrylate viscosity, index improver having a weight average molecular weight of 600,000 to 900,000 and a shear stability index of 25 to 60;

wherein the oil composition has a kinematic viscosity of 8.0 to 9.0 cSt at 100° C., a maximum kinematic viscosity of 7.0 cSt at 100° C. after 30 cycles shear, a maximum Brookfield viscosity of 17,000 cSt at −40° C. and a maximum pour point of −45° C.

2. The composition of claim 1 wherein the lubricating oil is a tractor hydraulic fluid.

3. The composition of claim 1 wherein the amount of paraffinic oil is from 55 to 85 vol. %, based on oil basestock.

4. The composition of claim 1 wherein the amount of naphthenic oil is from 15 to 45 vol. %, based on oil basestock.

* * * * *